US005579748A

United States Patent [19]

Kohl

[11] Patent Number: 5,579,748

[45] Date of Patent: Dec. 3, 1996

[54] DISC LAUNCHER WITH MULTI-LOADING CHAMBER

[75] Inventor: William K. Kohl, Haiku, Hi.

[73] Assignee: Testy Putts Corporation, Haiku, Hi.

[21] Appl. No.: 386,411

[22] Filed: Feb. 10, 1995

Related U.S. Application Data

[63] Continuation-in-part of Ser. No. 218,119, Mar. 25, 1994, Pat. No. 5,465,704.

[51] Int. Cl.[6] ..... F41J 9/18; F41B 3/04

[52] U.S. Cl. ..... 124/5; 124/42; 124/46

[58] Field of Search ..... 124/4, 5, 6, 42, 124/46

[56] References Cited

U.S. PATENT DOCUMENTS

| | | | |
|---|---|---|---|
| 1,607,874 | 11/1926 | Darton | 124/5 |
| 2,481,522 | 9/1949 | Livermon | 124/5 |
| 2,493,245 | 1/1950 | Hansen | 124/5 |
| 2,586,547 | 2/1952 | Marley | 124/5 |
| 2,994,313 | 8/1961 | Grahn | 124/6 |
| 4,157,828 | 6/1979 | Cosmopulos | 273/96 R |
| 4,347,828 | 9/1982 | Bridgeman | 124/5 |
| 4,548,413 | 10/1985 | David | 124/5 |
| 4,677,961 | 7/1987 | Allison | 124/5 |
| 4,730,595 | 3/1988 | Glass et al. | 124/5 |
| 4,872,688 | 10/1989 | Galvin | 273/326 |
| 4,974,574 | 12/1990 | Cutlip | 124/5 |
| 4,984,556 | 1/1991 | Glass et al. | 124/5 |
| 5,181,500 | 1/1993 | Chamberland | 124/5 |
| 5,232,226 | 8/1993 | Glickson | 273/323 |

*Primary Examiner*—John A. Ricci

[57] ABSTRACT

A rigid, hand-held disc launcher is provided for launching small cardboard discs, having a handle (1) attached to a head (2) which is curved in a substantially semi-circular arc of approximately 180°. A slot runs through the entire arc of the curved head with one slot opening (4) in the head preferably being located near the handle and the other slot opening (5) being located at the other end of the head. A disc inserted in the slot opening near the handle is launched from the other slot opening when accelerated by centrifugal forces caused by the disc launcher being swung forward by the handle. In another embodiment of the launcher, a cylindrical multi-loading chamber is provided on the flat portion of the head adjacent the handle. In this embodiment, the opening (4) is removed. The chamber has a cavity for storing discs. The launcher has an opening which allows the cavity to communicate with the slot. The launcher further has a tensioning arrangement for tensioning the discs against each other and against the opposing major wall defining the slot. The tensioning arrangement includes a stopper inserted within the chamber and a rubber band tensioning the stopper against the discs. A shaft is inserted in an opening in the head adjacent the handle. The shaft is adapted to slide and move a disc from a tensioned position within the slot to a freely movable position within the slot for launching thereof.

20 Claims, 8 Drawing Sheets

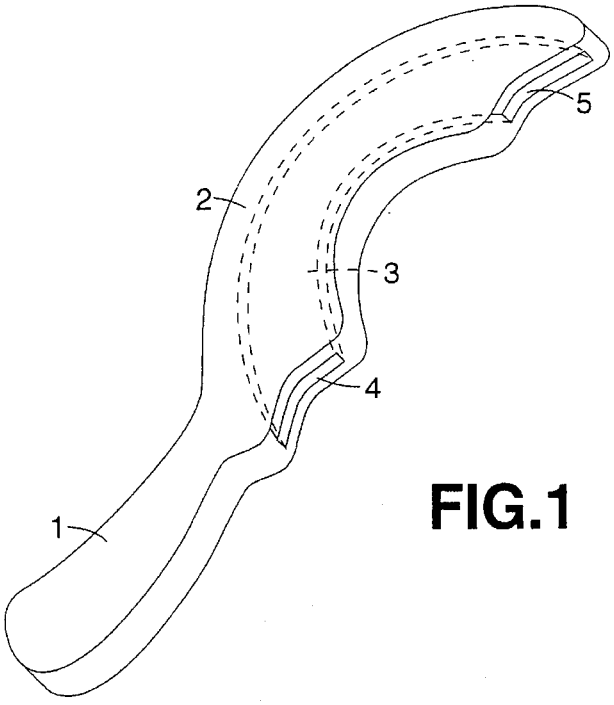
FIG.1
FIG.2
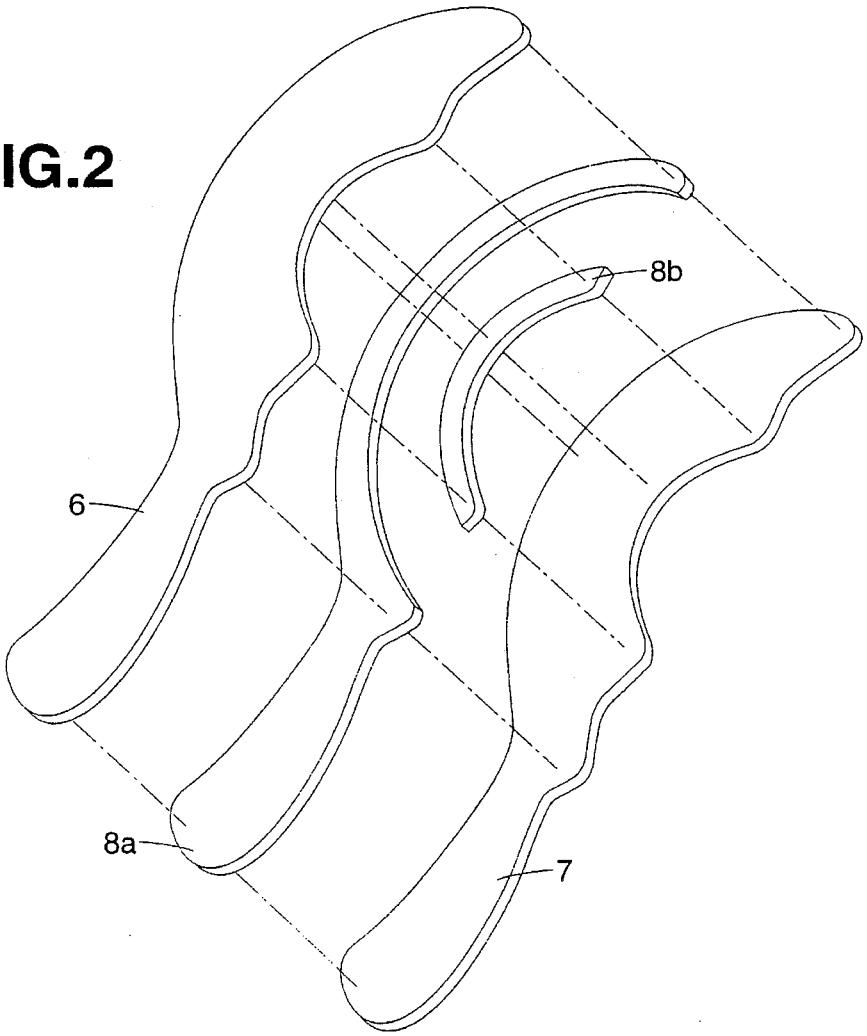

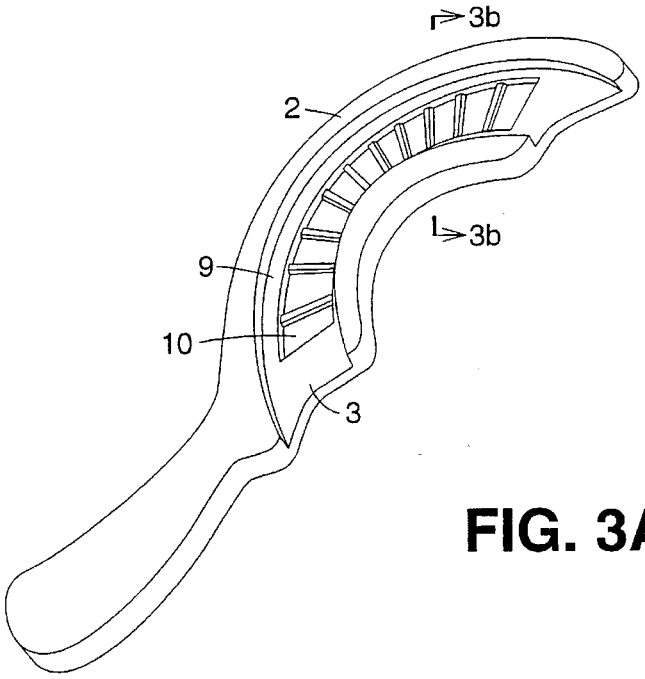
FIG. 3A
FIG. 3B
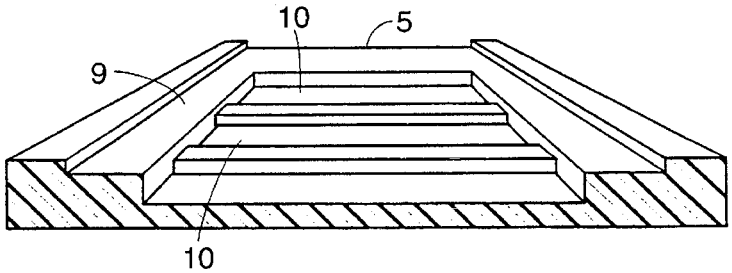
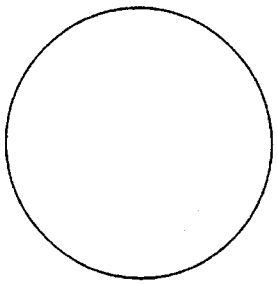
FIG. 4A
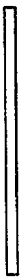
FIG. 4B

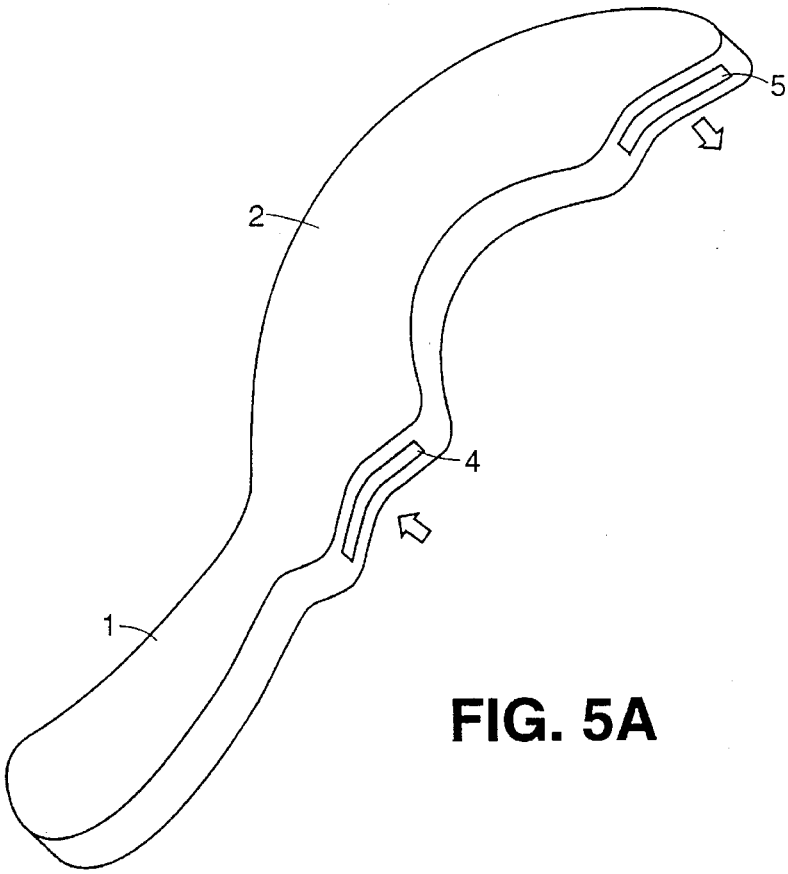
FIG. 5A
FIG. 5B
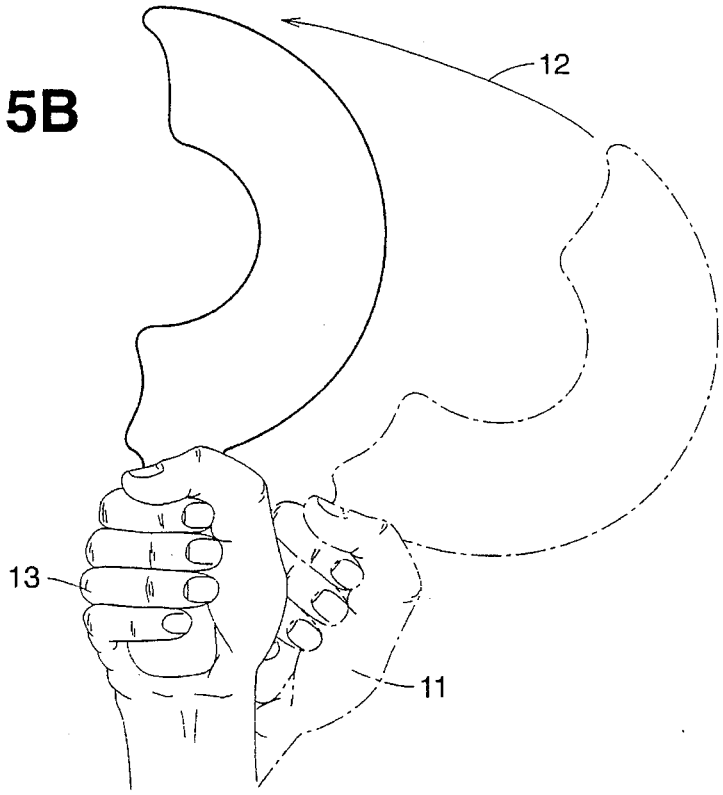

DISC LAUNCHER WITH MULTI-LOADING CHAMBER

This application is a continuation in part of U.S. application Ser. No. 08/218,119 filed Mar. 25, 1994, now U.S. Pat. No. 5,465,704 entitled "Disc Launcher".

BACKGROUND OF THE INVENTION

This invention relates to mechanical guns and projectors, and more particularly to disc launchers.

Prior to the contemporary popular appeal of new cardboard milk caps as well as antique milk caps as collectible items there has been little or no occasion for the creation of a launcher for small cardboard discs. Relatively inexpensive, milk caps now generate considerable interest among children as well as businesses that see milk caps with their logos as promotional material. No U.S. patents have been issued for launchers designed to utilize small cardboard discs, though inventors have created devices to launch the popular "Frisbee" type of flying disc.

U.S. Pat. No. 5,232,226 to Glickson Aug. 3, 1993; U.S. Pat. No. 5,181,500 to Chamberland Jan. 26, 1993; U.S. Pat. No. 4,984,556 to Glass Jan. 15, 1991 and U.S. Pat. No. 4,730,595 Mar. 15, 1988 also to Glass; U.S. Pat. No. 4,872,688 to Galvin Oct. 10, 1989; U.S. Pat. No. 4,347,828 to Bridgeman Sep. 7, 1982; and U.S. Pat. No. 4,157,828 to Cosmopulos Jun. 12, 1979 are all such flying disc launchers. U.S. Pat. No. 4,974,574 to Cutlip Dec. 4, 1990 is a multiple launcher for the popular plastic flying disc.

The launchers of Glickson, Chamberland, Galvin, and Cosmopulos are described as disc catchers as well and the Cosmopulos device is large and requires two hands to hold.

U.S. Pat. No. 2,493,245 to Hansen Jan. 3, 1950 and U.S. Pat. No. 2,481,522 to Livermon Feb. 28, 1945 as well as the afore mentioned Bridgeman, Glickson, and Glass launchers are complex devices with multiple functioning parts such as pivots, arms, clamps, hinges, and/or multiple handles.

Galvin, Glass, and Cutlip also describe their devices as being in some way flexible or having flexible members.

OBJECTS AND SUMMARY OF THE INVENTION

Accordingly, besides the objects and advantages of the disc launcher described herein, several objects and advantages of the present invention are:

(a) to provide a disc launcher that utilizes a commonly available, lightweight, and relatively inexpensive cardboard milk cap as a missile, (b) to provide a disc launcher whose ejective force and range are determined by the physical strength and skill of the user so to limit its capacity for harm among children, (c) to provide a disc launcher that would not launch common coins, (d) to provide a disc launcher with no moving or flexing parts, and (e) to provide a disc launcher that is possible to manufacture by both small scale and mass production methods.

A further object and advantage is to provide a disc launcher that is itself lightweight and of simple, inexpensive construction. Still further objects and advantages will become apparent from a consideration of the ensuing description and drawings.

The above objects are achieved by a disc launcher in accordance with the present invention. The disc launcher includes a handle and a means attached to said handle for launching a disc. The means for launching is a head having a proximal end adjacent the handle and a distal end. A curved slot runs through the entire arc of the curved head from the proximal end to the distal end. The slot is open at the proximal end and at the distal end.

The head is curved in a substantially semi-circular arc of approximately 180°. A disc inserted in the slot opening near the handle is launched from the other slot opening when accelerated by centrifugal forces caused by the disc launcher being swung forward by the handle.

In another embodiment of the launcher, a cylindrical multi-loading chamber is provided on the flat portion of the head discussed above at the proximal end adjacent the handle. The opening at the proximal end discussed above is removed. The chamber has a cavity for storing discs. The launcher has an opening which allows the cavity to communicate with the slot. The opening is sized to permit a disc to pass from the cavity to the slot. The launcher further has a tensioning means for tensioning the discs against each other and against the opposing major wall defining the slot.

The tensioning means includes a stopper inserted within the chamber and a rubber band tensioning the stopper against the discs. A shaft is inserted in an opening at the proximal end of the head adjacent the handle. The shaft is adapted to slide and move a disc from a tensioned position within the slot to a freely movable position within the slot for launching thereof.

Still further objects and advantages will become apparent from a consideration of the ensuing description and drawings.

BRIEF DESCRIPTION OF THE DRAWINGS

FIG. 1 shows a perspective view of a basic version of my disc launcher;

FIG. 2 shows an exploded view of the disc launcher of FIG. 1;

FIG. 3A shows the preferred embodiment of my disc launcher;

FIG. 3B shows a detail of the slot in the preferred embodiment of my disc launcher;

FIGS. 4A and 4B show a top plan view and a side view of a typical disk respectively;

FIGS. 5A and 5B show the operation of my disc launcher;

DETAILED DESCRIPTION OF THE PREFERRED EMBODIMENT

Figure 15:
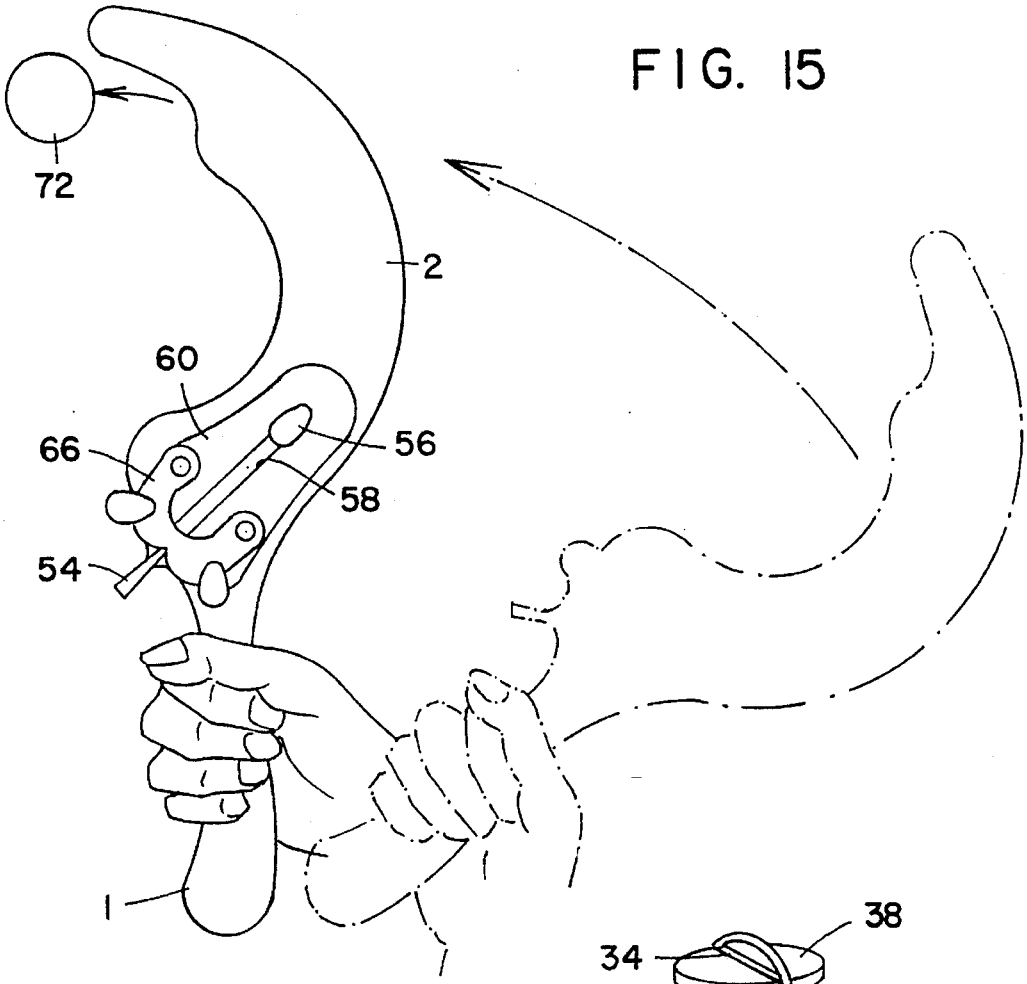
FIG. 15 illustrates the basic operation of the disc launcher shown in FIG. 6.

A basic version of my disc launcher in accordance with the invention is shown in FIG. 1 and FIG. 2. The disc launcher is constructed of pieces cut from approximately ⅛ inch thick rigid planar material such as chipboard or cardboard but not restricted to this material. FIG. 1 shows a handle 1 attached to a head 2 with a slot 3 in the head with a slot opening 4 and a slot opening 5. Head 2 is curved in a substantially semi-circular arc of approximately 180°. Head 2 has a proximal end adjacent handle 1 and a distal end adjacent the slot opening 5. Slot 3 runs the entire length of head 2, slot opening 4 being located at the end of the head nearest handle 1 and slot opening 5 being located at the other end of the head.

Slot 3 is created when, as indicated in FIG. 2, spacer 8*a* and spacer 8*b* are sandwiched between top-side piece 6 and bottom-side piece 7 and glued in place. Spacer 8*a* completes the structure of handle 1 and forms the outer curved wall of slot 3 and spacer 8*b* forms the inner curved wall of the slot. Spacers 8*a* and 8*b* are positioned approximately 5 cm apart.

Created by the assembly described above, slot 3 has a rectangular cross-sectional shape and measures roughly 0.35 cm on the minor walls by 5.0 cm on the major walls. The radius of the arc of the curved head is roughly 11.5 cm measured to the outside of the head. The disc launcher is typically 38.5 cm long including handle 1 and roughly 1.0 cm in thickness.

FIG. 3*a* shows the preferred embodiment of my disc launcher in accordance with the invention in which case the disc launcher is made of molded rigid plastic formed in complementary halves which are glued together. FIG. 3*a* shows one of the halves. The spacers 8*a* and 8*b* used to create slot 3 in the basic version in FIGS. 1 and 2 are formed in the mold as part of the complementary halves of the preferred embodiment and are thus eliminated as separate pieces. Additionally, slot 3 in FIG. 3*a* incorporates tracks 9 along the major walls of the slot and a series of troughs 10 recessed slightly below tracks 9 and set radially around the slot. A detail of the inner surfaces of slot 3 in the preferred embodiment is shown in FIG. 3*b*. Tracks 9 and troughs 10 can be clearly seen in FIG. 3*b* and slot opening 5 is shown at the rear of the detail. The curve of slot 3 as shown in FIG. 3*a* has been straightened in FIG. 3*b* to simplify the drawing.

OPERATION

FIGS. 4*a* and 4*b* show a typical cardboard disc known commonly in paper trade journals as a milk cap or "pog" but is referred to as a disc herein. FIG. 4*a* shows a view of a disc from either identical top or bottom face. FIG. 4*b* shows a disc from an oblate view as it would be inserted into slot opening 4 (FIG. 5*a*).

The manner of launching the above described disc with my disc launcher is to hold handle 1 in either the left hand or right hand as shown in FIG. 5*b*. The disc launcher is held approximately level and at the side of the body, slot openings 4 and 5 of head 2 facing forward. This body position is not shown. A disc is inserted into slot opening (FIG. 5*a*). The disc launcher is held with the hand cocked 11 slightly back as shown in FIG. 5*b* and then rapidly pivoted forward 12 by a snapping motion of the wrist. This snapping motion of the wrist generates centrifugal forces within the curve of the disc launcher, rolling the disc along the outer curved minor wall of slot 3. The disc accelerates as it travels through the slot and is launched-from slot opening 5 (FIG. 5*a*) as the user's hand reaches launch position 13 (FIG. 5*b*).

In the preferred embodiment shown in FIGS. 3*a* and 3*b* the disc travels as described above and is confined to the space between the major walls of slot 3 by tracks 9. Tracks 9 are set at just sufficient width as to facilitate passage of the appropriate disc but are wide enough apart so that common coins or other similar sized objects inserted into the launcher will not contact both tracks 9 on either major wall of slot 3, but will instead tend to catch in the recessed series of troughs 10 and thereupon not accelerate sufficiently for launching. The common coins would require shaking to dislodge.

Accordingly, the reader will see that the disc launcher of this invention will easily and effectively launch the described cardboard disc. Furthermore, the disc launcher has the further advantages in that it will not launch common coins; it has not moving, loose, or flexible parts and is therefore easy to assemble in a basic version or by mass-production methods in the preferred embodiment.

Additionally, its ejective force is determined by the user's physical strength as opposed to a triggering mechanism of some complex design so that the disc launcher's capacity for harm among small children is therefore reduced.

Note that many other variations for the disc launcher are possible within the spirit and scope of the invention. For example, the disc launcher can have two or more adjacent slots sandwiched into the head to simultaneously launch multiple discs. The size of the slot can be altered to accommodate a differently sized disc.

Figure 6:
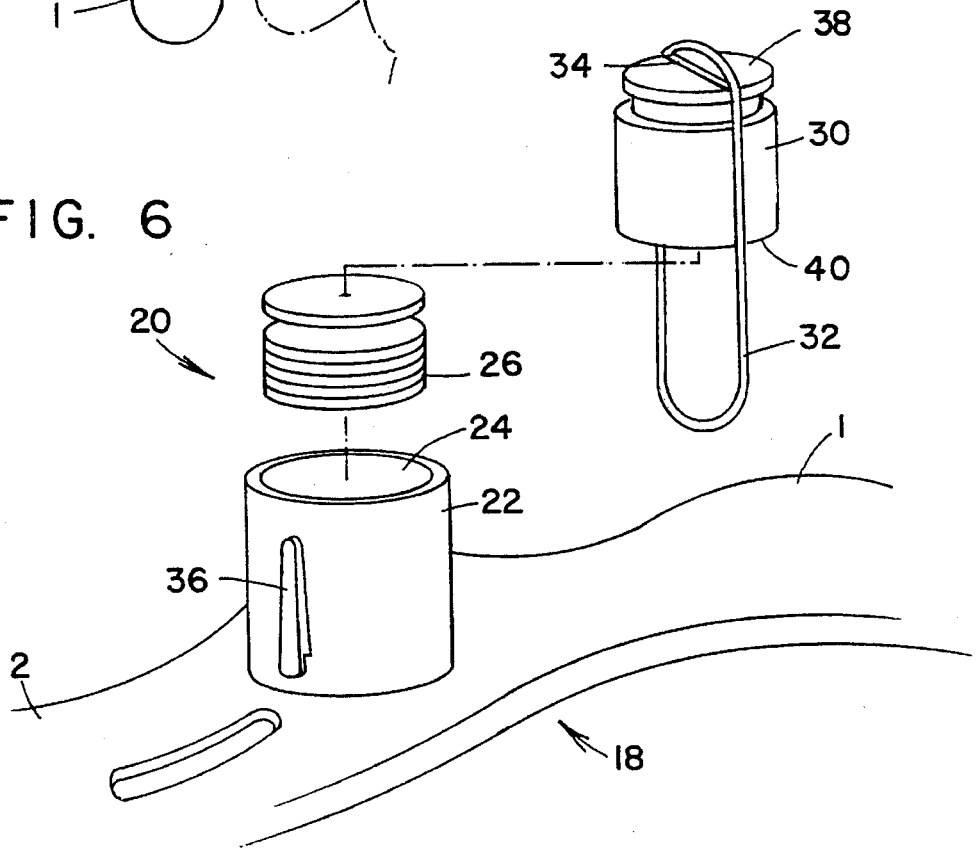
FIG. 6 illustrates an exploded perspective view of the disc launcher incorporating a multi-loading chamber according to another embodiment of the present invention.

Referring to FIG. 6, a disc launcher 18 is shown incorporating means for supplying a disc to the launcher for launching the disc in accordance with another embodiment of the present invention. This means is hereinafter referred to as a multi-loading chamber 20. The multi-loading chamber 20 includes a cylindrical tube 22 attached to the head 2 near the proximal end thereof adjacent handle 1. The tube 22 is molded on the outside surface of head 1. The tube 22 has an opening 24 for receiving a plurality of discs 26 and a cavity (not shown in FIG. 6) in communication therewith for storing the discs 26. In this embodiment, note that the disc launcher has been molded to remove opening 4 for receiving a disc inserted by hand which exists in the embodiments shown in FIGS. 1–5B.

The multi-loading chamber 20 further includes a tension means which comprises a cylindrical stopper 30 and a rubber band 32. Cylindrical stopper 30 has a diameter in cross-section just slightly smaller than the diameter of tube 22. This allows stopper 30 to enter opening 24 and slide freely within the cavity of tube 22. The stopper 30 has a groove 34 on the top surface 38 thereof extending across the diameter thereof. Cylindrical tube 22 includes a ledge 36 on each side thereof (only one shown in FIG. 6).

Figure 12:
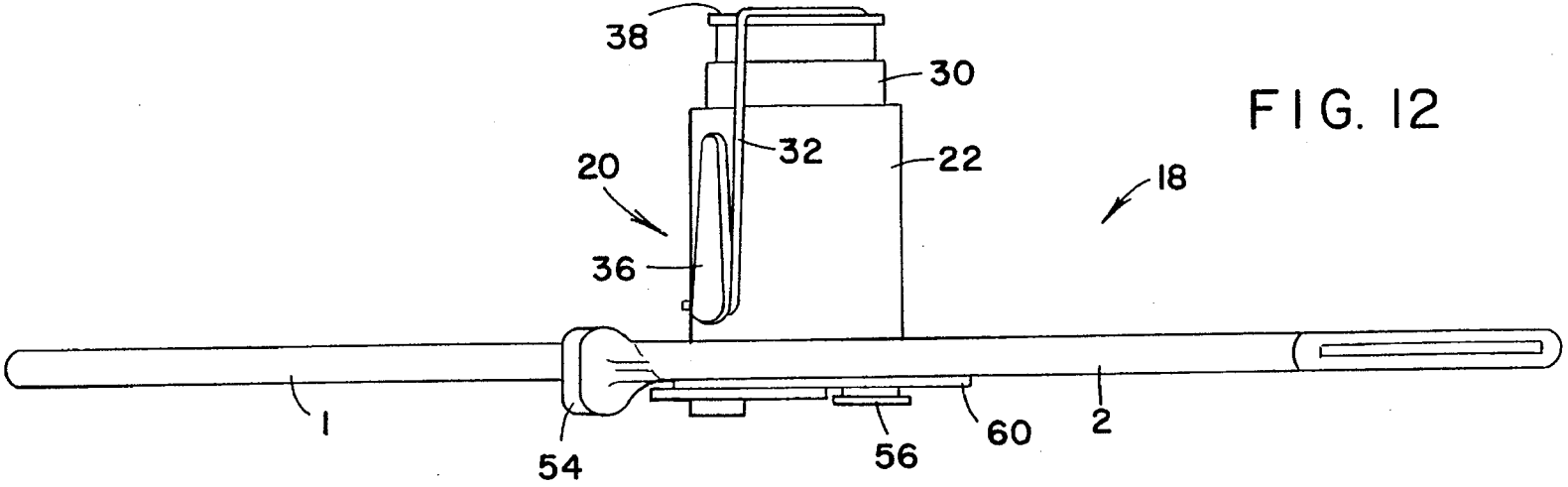
FIG. 12 illustrates a side view of the disc launcher shown in FIG. 6.

As best shown in FIG. 12, rubberband 32 fits within groove 34 on top surface 38 of stopper 30 and wraps around ledges 36 in order to tension or bias the bottom surface 40 of stopper 30 against discs 26 stored in the tube 22. The discs 26 are thus generally tensioned against the opposing major wall of slot 3. This will be discussed in more detail below.

Referring to FIGS. 7–14, multi-loading chamber 20 further includes a loading mechanism 50 for loading a disc in a launching position within slot 3. Loading mechanism 50 includes a shaft 52 positioned within an opening at the proximal end of the launcher 18. The shaft 52 includes a knob 54 at one end thereof and a guide 56 at the other end thereof. The knob 54 is appropriately shaped so that a child may easily grasp it with his/her thumb and forefinger.

Figure 11:
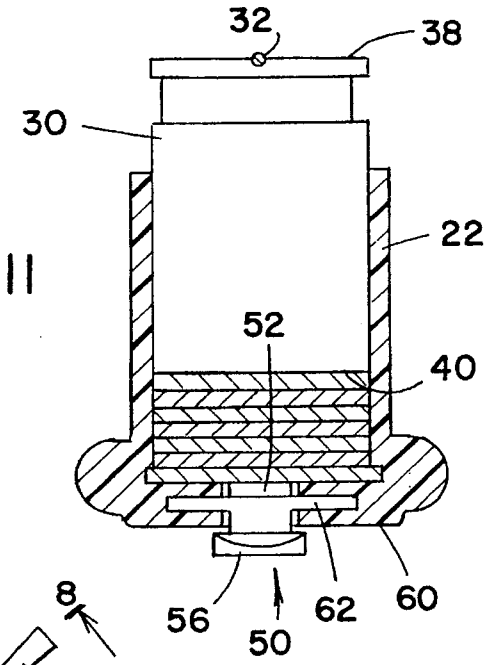
FIG. 11 illustrates a cross sectional view of the disc launcher shown in FIG. 9 taken along lines 11—11.
Figure 13:
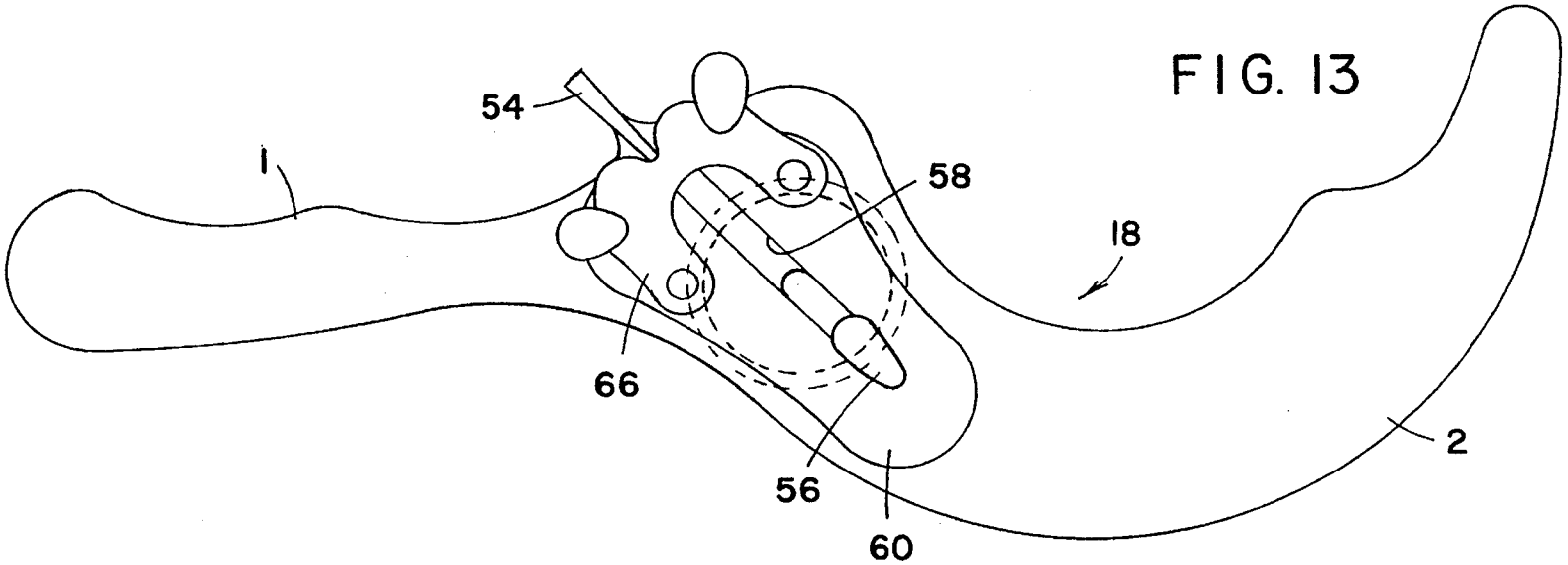
FIG. 13 illustrates a bottom plan view of the disc launcher shown in FIG. 6.

As best seen in FIGS. 11 and 13, the launcher 18 includes a linear opening 58 along the bottom thickened portion 60 thereof and a channel 62 in the rear thereof which communicates with the linear opening 58 and the opening in the rear of the launcher 18 for shaft 52. The channel 62 is shaped in the form of a "cross" as best seen in FIG. 11. The shaft 52 is shaped similarly to channel 62 and adapted to slide therethrough. Guide 56 extends through linear opening 58 in the launcher 18 along the bottom thickened portion 60 thereof.

Figure 10:
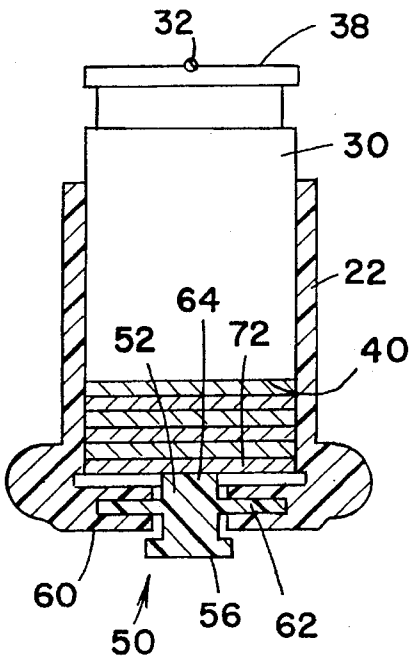
FIG. 10 illustrates a cross sectional view of the disc launcher shown in FIG. 8 taken along lines 10—10.
Figure 7:
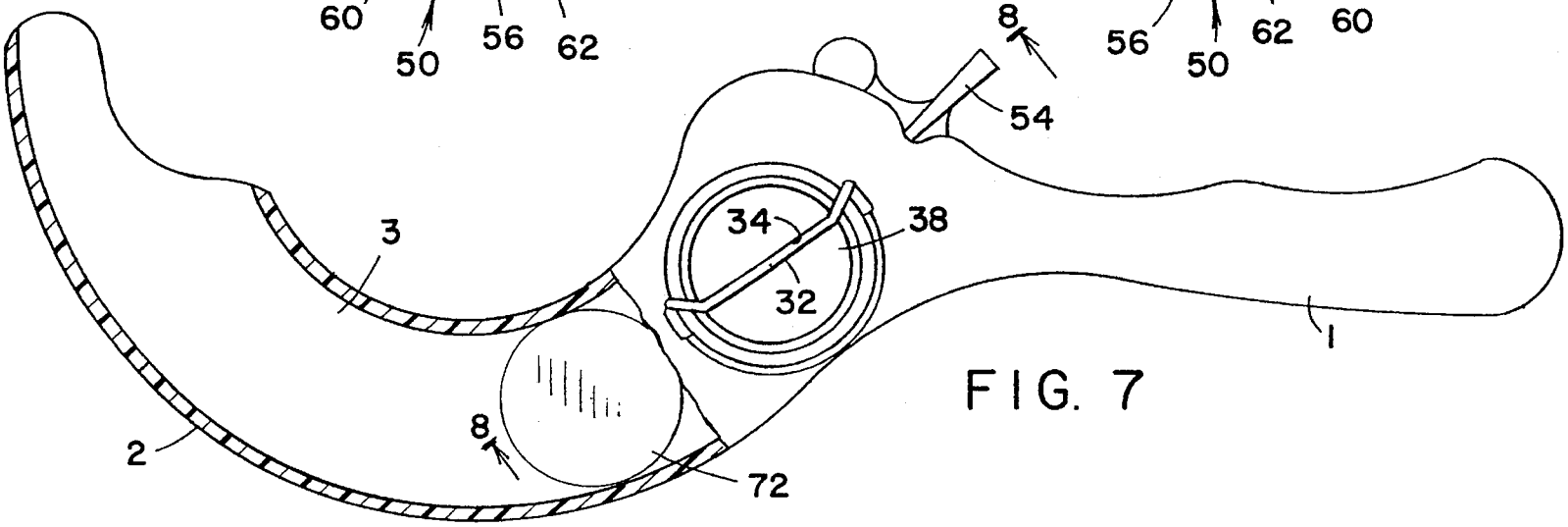
FIG. 7 illustrates a top plan view of the disc launcher shown in FIG. 6.

As best seen FIG. 10, shaft 52 has a raised portion 64 substantially along the length thereof as one of the sides that defines its "cross" shape. The raised portion 64 communicates with the cavity of tube 22 to contact the bottom disc 72 as discussed below. The launcher 18 includes a brace 66 screwed to the thickened portion 60 of the launcher 18 at the proximal end thereof. The brace 66 is generally shaped in the form of a "U" having the open area facing the guide 56.

The brace 66 is positioned on the launcher 18 to permit the shaft 52 to move between two positions. In the first position, the shaft 52 is fully extended and the guide 56 is braced against brace 66. In the second position, the shaft 52 is fully inserted within the launcher 18, and guide 56 is braced against the edge defining the end of linear opening 60 farthest from brace 66.

Figure 9:
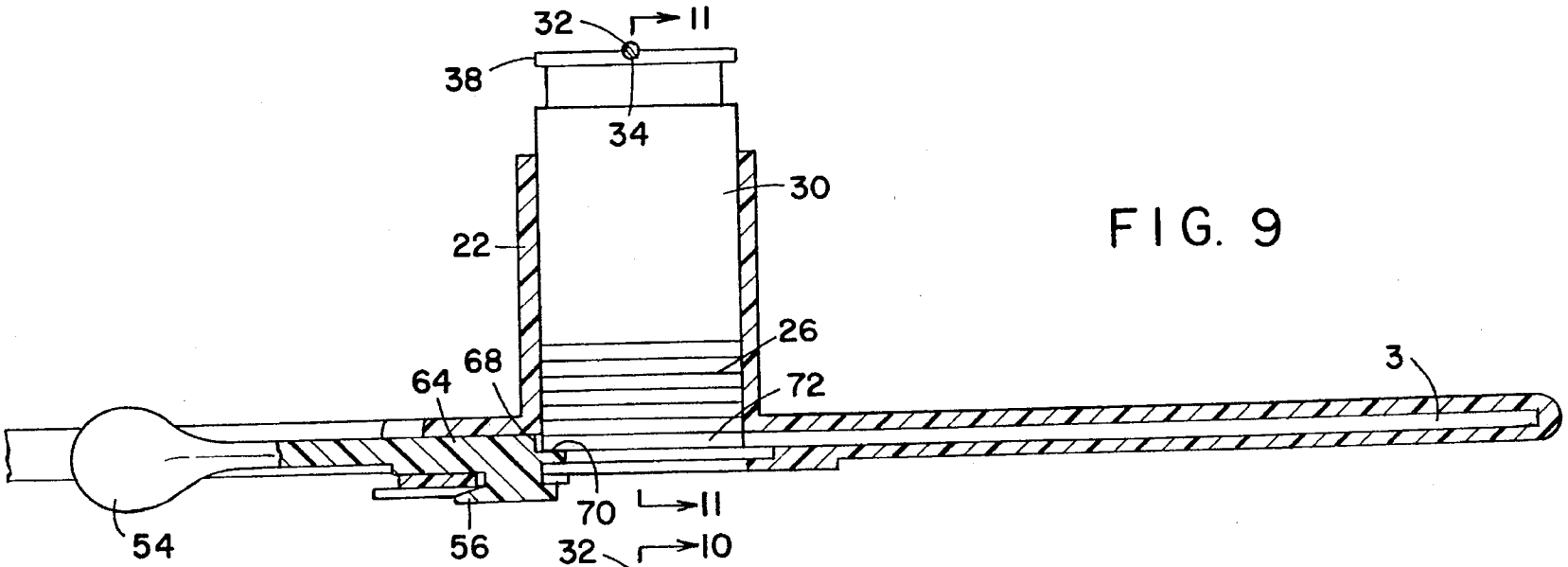
FIG. 9 illustrates a cross-sectional view of the disc launcher taken along lines 8—8 in FIG. 7 with a disc in an unloaded non-launching stored state.
Figure 8:
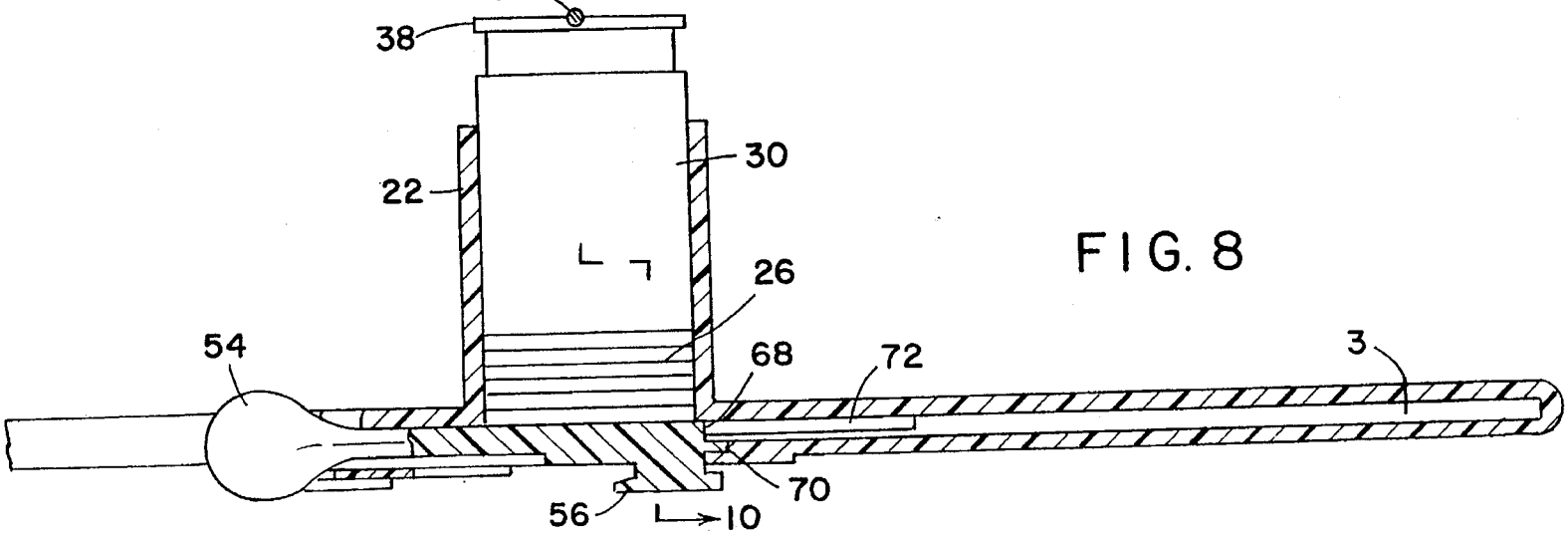
FIG. 8 illustrates a cross-sectional view of the disc launcher taken along lines 8—8 in FIG. 7 with a disc loaded in a launching state.
Figure 14:
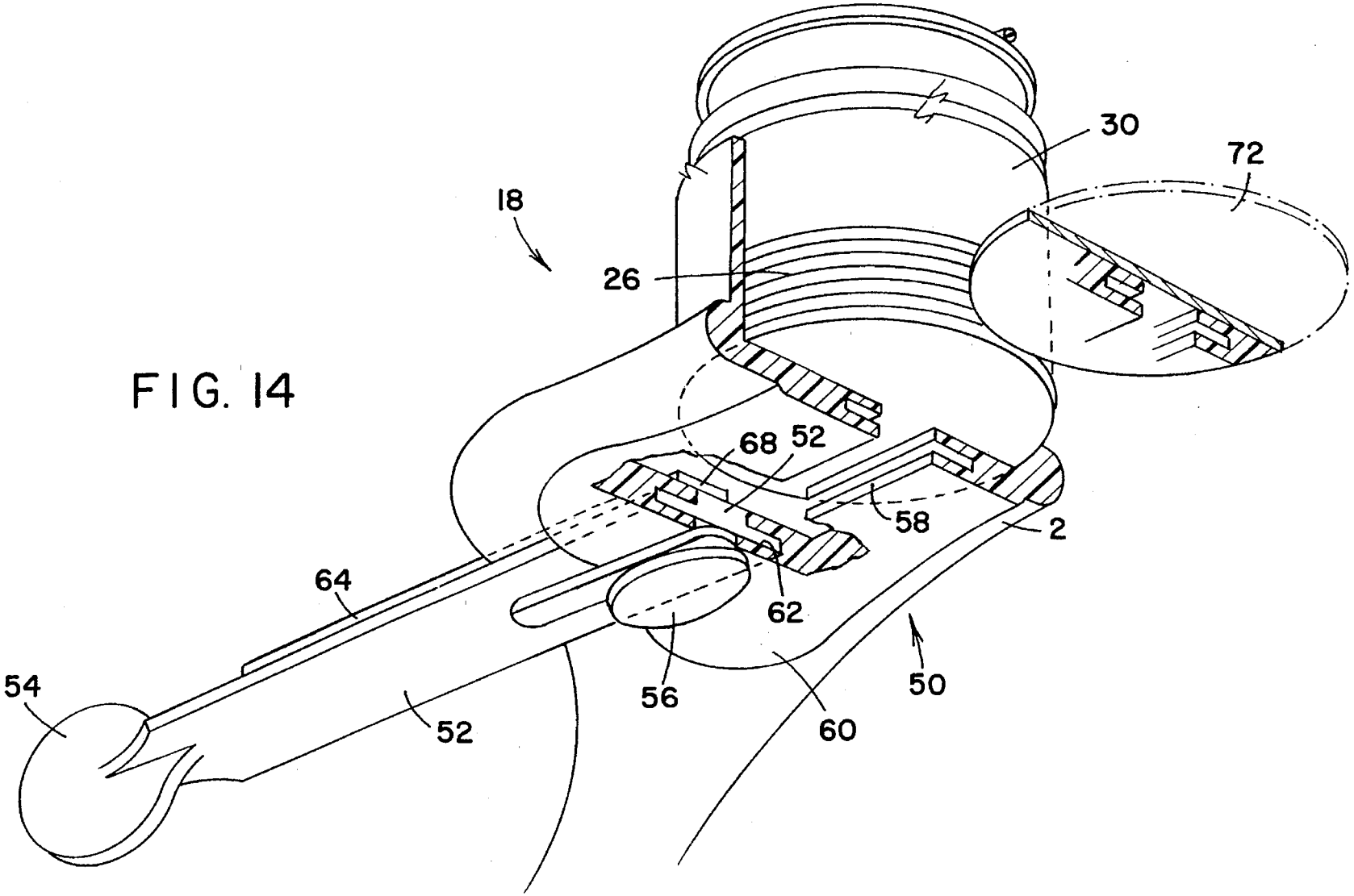
FIG. 14 illustrates the disc launcher of FIG. 6 showing multi-loading chamber in an open cut view.

As best seen in FIGS. 8, 9 and 14, the raised portion 64 extends along the top length of shaft 52 but terminates, short of the end thereof, with wall 68, leaving a ledge 70 on shaft 52 adjacent guide 56.

In the second position, the top surface of the raised portion 64 acts as part of the surface of the major wall of the track (not shown in FIGS. 6–15). Note that the disc launcher 18 in this embodiment includes the same track and troughs structure in the slot discussed above with respect to the preferred embodiment shown in FIGS. 1–5B. As stated above, the discs 26 are biased within tube 22.

In the first position of the shaft 52 shown in FIG. 9, the wall 68 is aligned parallel to the wall of tube 22, positioned just outside thereof. Because tension is maintained on all of the discs within the cavity including disc 72 next to be launched, the bottom disc 72 remains flush against the (1) opposing major wall of the track in the slot 3 and the (2) ledge 70. In this position, the disc 72 is in an unlaunching state. In the second position as shown in FIG. 8, the disc is in an unbiased position within the slot 3 free for launching.

In operation, a child would grasp the knob 54 and pull the shaft into the first position so that the next disc in sequence may move into the slot 3. The child would then push the shaft 52 into channel 62. The wall 68 contacts the peripheral edge of the disc 72 and causes it to slide into the launching position in slot 3 shown in FIG. 8. The disc 72 may then be launched. The next disc in sequence in the cavity will then move down once the shaft 52 is pulled back to its extended position. Since the multi-loading chamber holds several discs this process may be repeated many times.

FIG. 15 illustrates the basic operation of the disc launcher with this multi-loading chamber. Note that because tension is maintained on all discs by the biasing structure, i.e., the rubber band 32 and stopper 30, the launcher 18 may be operated by right handed as well as left handed children.

Although the present invention has been described with reference to the preferred and additional embodiments, it will be apparent to one skilled in the art that variations and modifications may be made within the spirit and scope of the invention, that the drawings and description of the preferred and other embodiments are made by way of example rather than to limit the scope of the invention, and it is intended to cover within the spirit and scope of the invention all such changes and modifications.

I claim:

1. An apparatus for launching a disc comprising:

(a) a handle;

(b) means engaging said handle for launching a disc; and (c) means for supplying said disc to said means for launching, said means for supplying includes means for holding a plurality of discs, said means for launching comprises a slot extending substantially the length thereof and shaped to permit said disc to pass therethrough and an opening sized to permit said disc to move from said means for holding to said slot, said means for supplying further comprises means for tensioning said plurality of discs against a wall defining said slot.

2. The apparatus of claim 1 wherein said means for holding has a cavity for storing said plurality of discs.

3. The apparatus of claim 1 wherein said means for supplying further comprises means for moving a disc from a tensioned position within said slot to a freely moveable position within said slot for the launching thereof.

4. The apparatus of claim 3 wherein said means for moving includes means for sliding said disc from said tensioned position to said movable position.

5. The apparatus of claim 4 wherein said means for sliding is a shaft adapted to slide within said means for launching.

6. The apparatus of claim 5 wherein said shaft comprises a first end for contacting said disc and a second end having a knob for grasping.

7. The apparatus of claim 6 wherein said first end of said shaft comprises a wall for causing said disc to slide from said tensioned position to said movable position.

8. The apparatus of claim 7 wherein said shaft defines a ledge for supporting said disc.

9. The apparatus of claim 1 wherein said means for holding said plurality of discs is cylindrically shaped.

10. The apparatus of claim 1 wherein said means for holding has an opening communicating with said cavity to receive said discs.

11. The apparatus of claim 10 wherein said means for tensioning includes a stopper in said opening and against said plurality of discs and a rubber band for tensioning said stopper against said discs.

12. An apparatus for launching a disc comprising:

(a) a handle;

(b) means engaging said handle for launching a disc through an opening formed therein, (c) means for holding a plurality of discs, said means for launching comprises a slot extending substantially the length thereof and shaped to permit said disc to pass therethrough and an opening sized to permit said disc to move from said means for holding to said slot, said means for launching said discs further comprises means for moving a disc from a tensioned position within said slot to a freely moveable position within said slot for the launching thereof.

13. The apparatus of claim 12 wherein said means for launching further comprises means for tensioning said plurality of discs against a wall defining said slot.

14. The apparatus of claim 13 wherein said means for holding has a cavity for storing said plurality of discs.

15. The apparatus of claim 12 wherein said means for moving includes means for sliding said disc from said tensioned position to said movable position.

16. The apparatus of claim 15 wherein said means for sliding is a shaft adapted to slide within said means for launching.

17. The apparatus of claim 16 wherein said shaft comprises a first end for contacting said disc and a second end having a knob for grasping and moving said shaft.

18. The apparatus of claim 17 wherein said first end of said shaft comprises a wall for causing said disc to slide from said tensioned position to said movable position.

19. The apparatus of claim 18 wherein said shaft defines a ledge for supporting said disc.

20. The apparatus of claim 12 wherein said means for holding said plurality of discs is cylindrically shaped.

* * * * *